US006563422B1

(12) United States Patent
Wiget et al.

(10) Patent No.: US 6,563,422 B1
(45) Date of Patent: May 13, 2003

(54) NON ACOUSTIC ALARM DEVICE

(75) Inventors: Fridolin Wiget, Neuchâtel (CH); Stéphane Künzi, Cormondrèche (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 09/937,148

(22) PCT Filed: Mar. 25, 1999

(86) PCT No.: PCT/EP99/02027

§ 371 (c)(1),
(2), (4) Date: Sep. 21, 2001

(87) PCT Pub. No.: WO00/58923

PCT Pub. Date: Oct. 5, 2000

(51) Int. Cl.[7] ..... G08B 21/00

(52) U.S. Cl. ..... 340/540; 340/407.1; 340/825.19; 340/825.46

(58) Field of Search ..... 340/540, 825.19, 340/407.1, 825.46, 573.1; 455/86, 90, 550, 567, 575

(56) References Cited

U.S. PATENT DOCUMENTS 5,007,106 A * 4/1991 Kudoh et al. ..... 455/344
5,436,622 A 7/1995 Gutman et al.
5,602,432 A * 2/1997 Mizutani ..... 310/15
5,736,797 A 4/1998 Oudet et al.
5,764,594 A * 6/1998 Berman et al. ..... 368/12
6,211,775 B1 * 4/2001 Lee et al. ..... 340/407.1
6,218,958 B1 * 4/2001 Eichstaedt et al. ..... 340/825.46
6,281,785 B1 * 8/2001 Hamaguchi ..... 340/407.1

FOREIGN PATENT DOCUMENTS

| | | |
|---|---|---|
| EP | 0 938 034 | 8/1999 |
| GB | 2 316 574 | 2/1998 |
| WO | WO 99-01849 | 1/1999 |

* cited by examiner

*Primary Examiner*—Toan Pham
(74) *Attorney, Agent, or Firm*—Griffin & Szipl, P.C.

(57) ABSTRACT

The invention concerns a non acoustic alarm device, intended to be fitted to a unit worn in contact with the body, such as a timepiece or a portable telephone, including a case, a moving mass within said case intended to transmit vibrations thereto, a coil (L) electromagnetically coupled to said moving mass to cause it to oscillate, and an excitation circuit of said coil. According to the invention, the device includes means for measuring the instantaneous oscillation frequency of the coil-moving mass unit during the oscillation in progress, as well as means for generating a series of excitation pulses for said coil during the following oscillation, whose characteristics are a function of the measurement of said instantaneous oscillation frequency. Due to its high yield and low energy consumption, this device is particularly suitable for watches.

11 Claims, 13 Drawing Sheets

NON ACOUSTIC ALARM DEVICE

Figure 1:
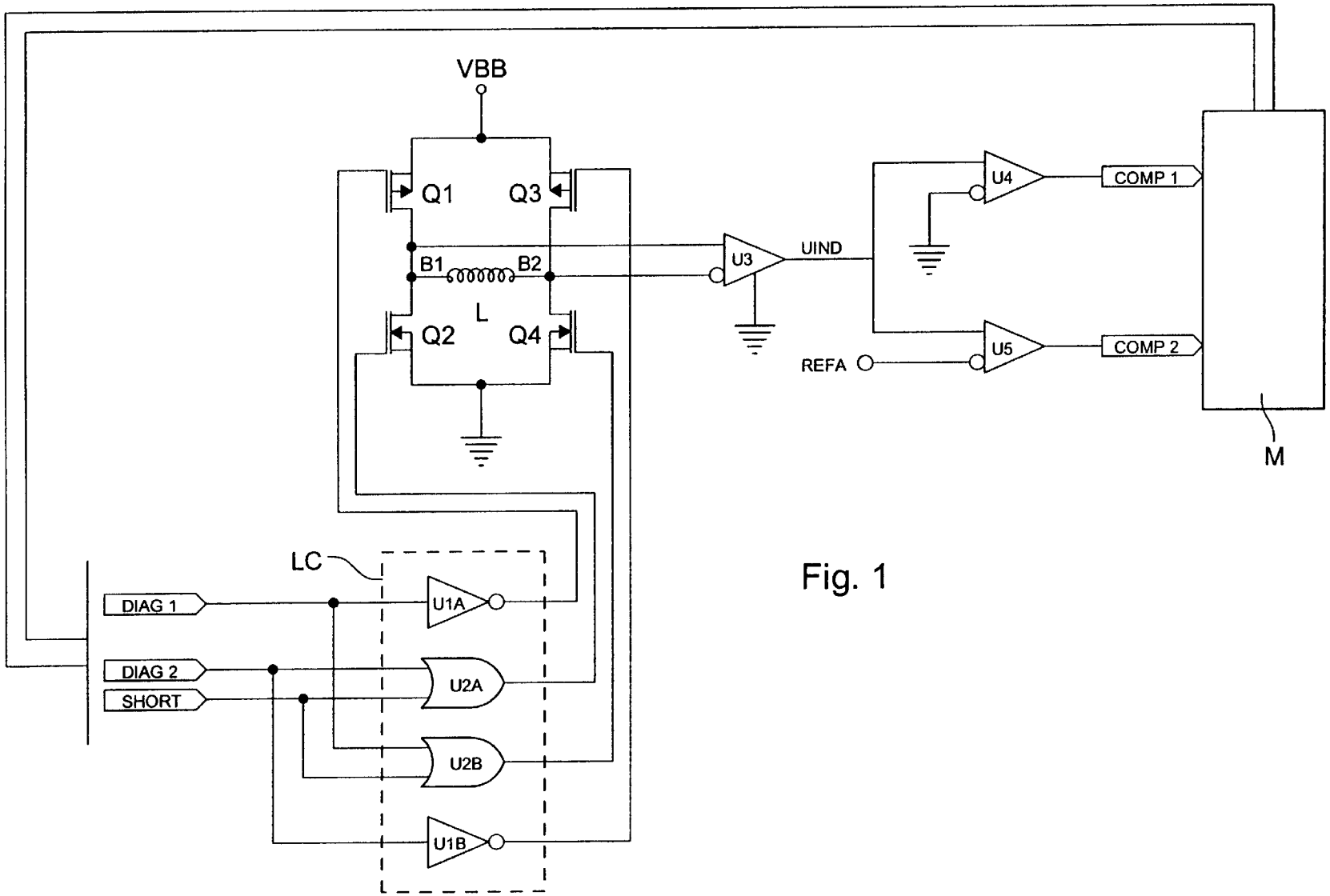

The present invention relates to a non acoustic alarm device, intended to be fitted to a portable unit in contact with the body, such as a watch, a portable telephone or a pager.

In numerous situations, it is useful to be able to transmit a piece of information to a person other than by acoustic or visual means. This is the case in particular when one wishes to alert a person who is in the middle of a meeting.

Tactile data transmission means offer an advantageous alternative for this purpose: a unit worn by the person next to the body, such as a watch for example, is made to vibrate, in order to stimulate his skin locally to indicate to him a given time or the occurrence of an event (arrival of a message, a call, a meeting, etc.).

Vibrating devices of the type with an unbalanced mass mounted on a rotor are known to those skilled in the art. In these devices, typically, the unbalanced mass rotates at a speed of several tens of revolutions per second thanks to an electric motor which is supplied with a power of several tens of milliwatts and started at the moment when the message has to be perceived by the wearer.

These devices have the main drawback of consuming a lot of energy, which is incompatible with the battery miniaturisation requirements encountered within the horological field.

European Patent Application EP 0 625 738 in the name of the Applicant discloses a vibrating device for a unit such as a watch. This device includes a coil electromagnetically coupled to a moving mass.

This patent application does not describe the characteristics of the excitation means of the coil. Having said this, those skilled in the art know that pulses whose frequency is equal to the natural oscillation frequency of the coil-moving mass unit have to be applied to the coil to obtain a maximum vibration amplitude for a given quantity of supplied energy.

In practice, this natural frequency is difficult to determine strictly. First, it varies from one coil-moving mass unit to another because of manufacturing tolerances, which are of the order of 15%.

Next, it varies as a function of the way in which this unit is worn, and forms a body with the wearer. Typically, the wear conditions induce variations of the order of 5% of the unit's natural frequency, as well as a variation in the energy dissipated in the wearer.

These variations reduce the yield of the coil excitation means which are designed to operate at a fixed frequency, and this results in a significant waste of energy.

The object of the present invention is to overcome these drawbacks.

This object of the invention, in addition to others which will appear upon reading the following description, is achieved with a non acoustic alarm device, intended to be fitted to a portable device worn next to the body, such as a timepiece or a portable telephone, including a case, a mass moving within this case intended to transmit vibrations thereto, a coil electromagnetically coupled to said moving mass to make it vibrate, and an excitation circuit of said coil, this device being characterised in that it also includes means for measuring the instantaneous oscillation frequency of the coil-moving mass unit during the oscillation in progress, as well as means for generating a series of excitation pulses for said coil during the next oscillation, whose characteristics are a function of the measurement of said instantaneous oscillation frequency.

As a result of these characteristics, it becomes possible to make a non acoustic alarm device which does not require much energy and which operates with a good yield, which means that the use thereof in particular in timepieces of small dimensions, such as watches, can be envisaged.

Figure 2:
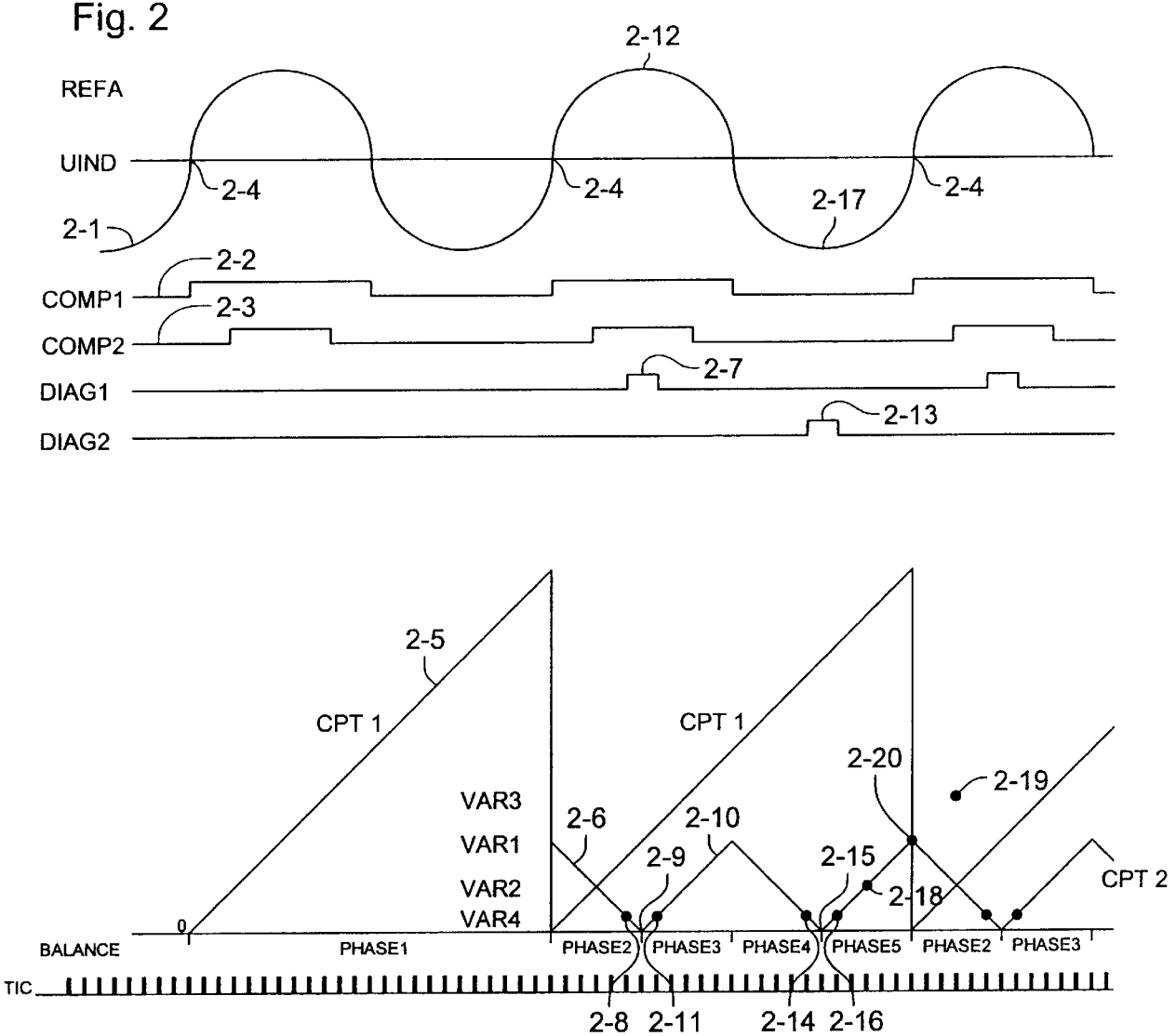
Figure 11:
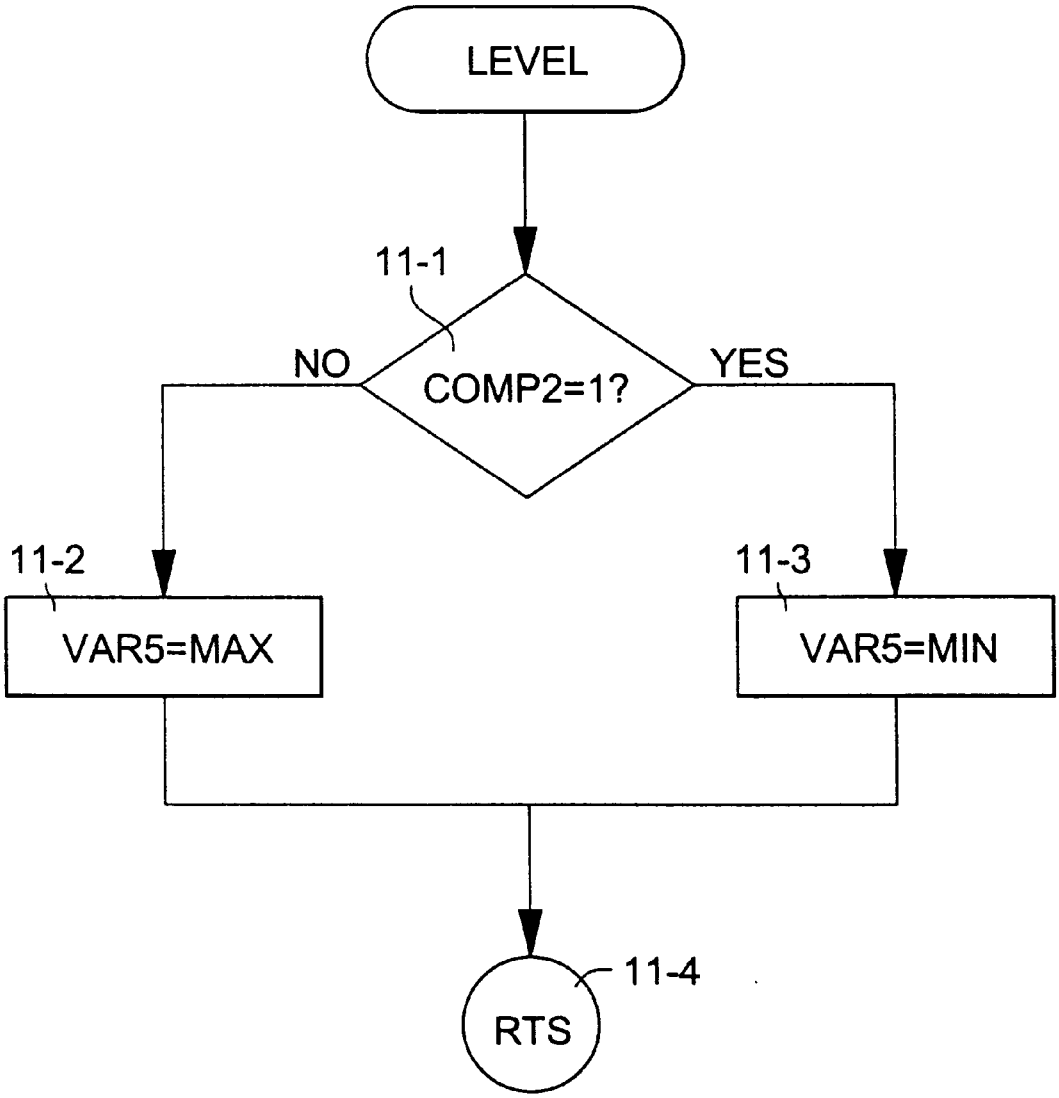
Figure 12:
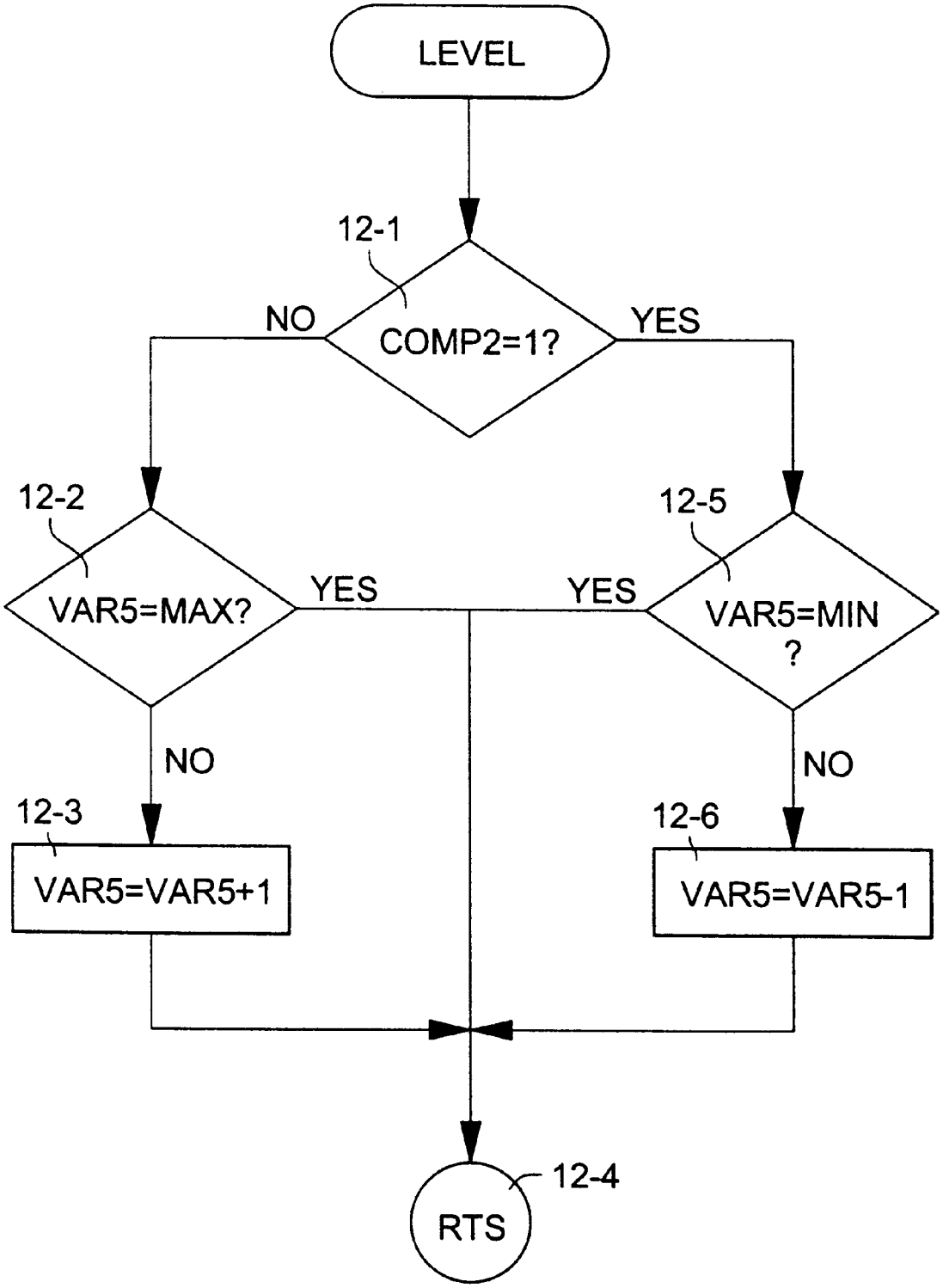
Figure 13:
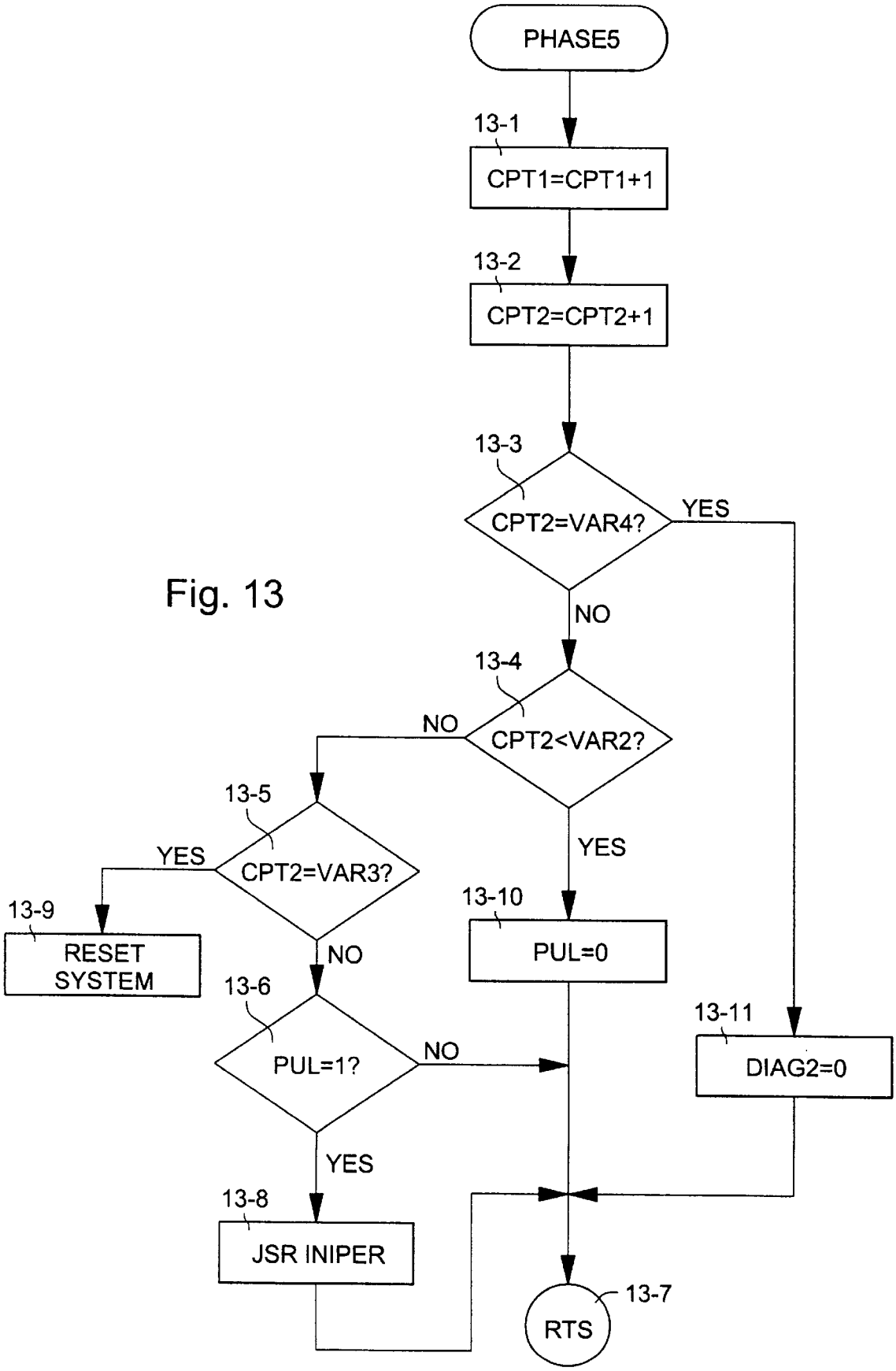

Other characteristics and advantages of the present invention will appear upon reading the following description and the annexed drawings which are given solely by way of example, and in which:

FIG. 1 shows the excitation circuit of the coil of the device according to the invention, as well as a measuring circuit connected to its terminals;

FIG. 2 shows the diagram of the operating principle of the device according to the invention; and FIGS. 3 to 13 show flow charts of a computer program intended to operate in interface with the excitation and measuring circuits of the coil, in accordance with the operating principle indicated by the diagram of FIG. 2. FIG. 13 shows the flow chart of the main program, and FIGS. 4 to 13 show the flow charts of sub-programs directly or indirectly connected to the main program.

In these Figures, identical numerical references represent identical or similar components or elements.

In a preferred embodiment, the device according to the invention includes similar structural components to those described in aforementioned European Patent Application EP 0 625 738. It therefore includes a case (not shown), a moving mass (not shown) within such case intended to transmit vibrations thereto, and a coil L electromagnetically coupled to this moving mass.

This coil is schematically shown in FIG. 1. Its first B1 and second B2 terminals are capable of being carried at a zero voltage or at a voltage VBB according to the states of four power transistors Q1, Q2, Q3, Q4.

These transistors are controlled by a control logic LC typically including first U1A and second U1B inverters, as well as first U2A and second U2B OR logic gates.

As a function of first DIAG1, second DIAG2 and third SHORT input signals applied to control logic LC, power transistors Q1, Q2, Q3, Q4 and coil L occupy the states indicated by the following truth table:

| DIAG1 | DIAG2 | SHORT | Q1 | Q2 | Q3 | Q4 | COIL L |
|---|---|---|---|---|---|---|---|
| 0 | 0 | 0 | NC | NC | NC | NC | high impedance |
| 1 | 0 | 0 | C | NC | NC | C | B1 = VBB; B2 = 0 |
| 0 | 1 | 0 | NC | C | C | NC | B1 = 0; B2 = VBB |
| 0 | 0 | 1 | NC | C | NC | C | short circuit |

NB: NC = non conductive;
C = conductive

The first B1 and second B2 terminals of coil L are further connected to a measuring circuit including a differential amplifier U3 and first U4 and second U5 comparators.

Amplifier U3 returns the induced voltage UIND measured between the terminals of the coil (see curve 2-1 in FIG. 2).

The first comparator U4 compares induced voltage UIND to 0. It provides an output signal COMP1, which has the value 1 when induced voltage UIND is positive and a value 0 when said voltage is negative (see curve 2-2 in FIG. 2).

The second comparator U5 compares induced voltage UIND to a reference voltage REFA. It provides an output signal COMP2, which has the value 1 when induced voltage UIND is greater than REFA, and which has the value 0 in the converse case (see curve 2-3 in FIG. 2).

The excitation and measuring circuits described hereinbefore operate in interface with a unit capable of executing a computer program, such as a microprocessor or microcontroller M.

The object of the following is the description of such a computer program which allows, from an activation signal ALARM of the device according to the invention and from output signals COMP1 and COMP2, to control over time input signals DIAG1, DIAG2 and SHORT so as to cause the coil-moving mass unit to oscillate by providing the minimum energy.

In the following description, returns to the different operations of the program are indicated in brackets.

This description will usefully be enlightened by the diagram of FIG. 2. Reference will therefore be made thereto as frequently as possible.

Figure 3:
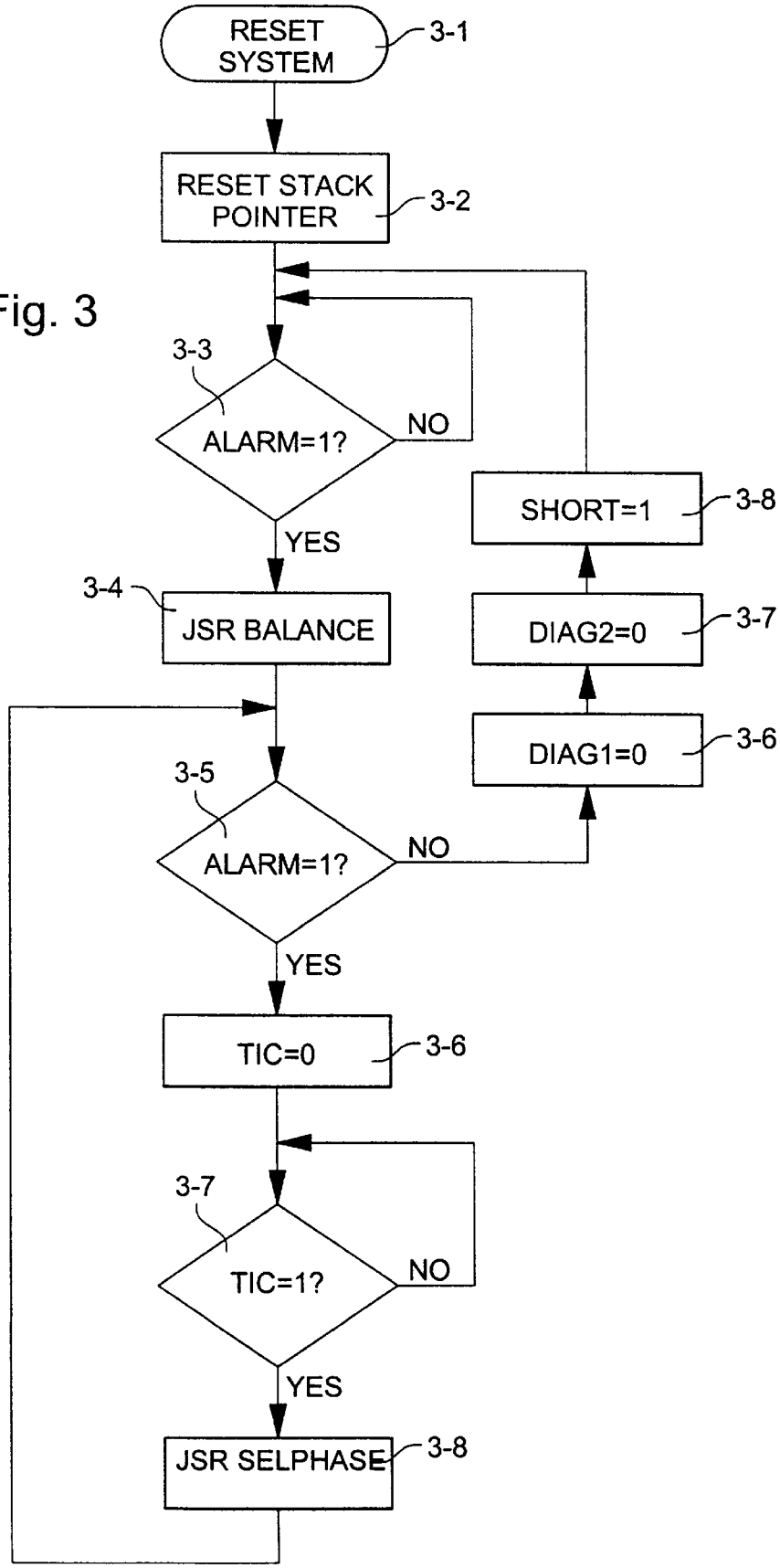
Figure 4:
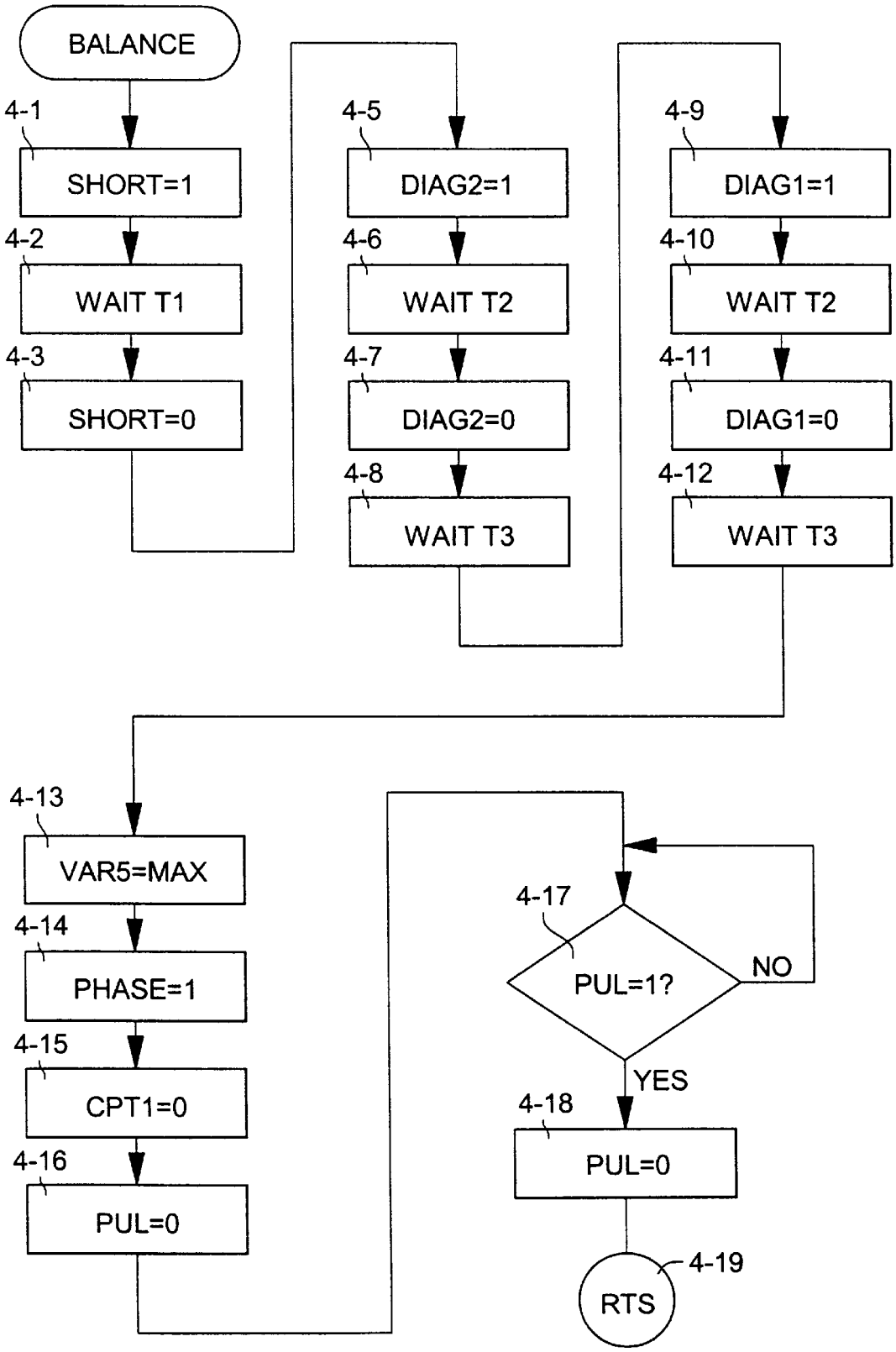

As can be seen in FIG. 3, prior to any operation, the main program (3-1) starts with initialisation of its internal variables (3-2).

Next, the main program tests the signal ALARM (3-3), which has the value 1 when the device according to the invention is activated, and 0 otherwise. If ALARM equals 0, the main program restarts the test; if ALARM equals 1, the main program executes sub-program BALANCE (3-4) which is detailed in FIG. 4.

Sub-program BALANCE begins by setting signal SHORT at 1 (4-1), the two signals DIAG1 and DIAG2 having further been set at 0 during the initialisation step (3-2). With reference to the above truth table, it can be seen that coil L is thus short-circuited, which has the effect of damping any movement of the coil-moving mass unit.

One then waits for a sufficient period of time T1 (4-2) for the unit to come to rest, then signal SHORT is set at 0 (4-3): the coil-moving mass unit is then ready to oscillate freely.

Next, signal DIAG2 is set at 1 (4-5). After a period of time T2 (4-6), this signal is reset at 0 (4-7). A first pulse—conventionally called a positive pulse—is thereby sent to the coil-moving mass unit.

After a period of time T3 (4-8), signal DIAG1 is set at 1 (4-9). After a period of time T2 (4-10), this signal is reset at 0 (4-11). A second pulse, of the opposite sign to that of the first pulse, is thereby sent to the coil-moving mass unit.

T2 and T3 are selected so that the sum thereof is substantially equal to a half the nominal natural oscillation period of the coil-moving mass unit. For example, in the typical case in which this unit has a nominal natural frequency of 166 Hz, i.e. a nominal natural period of 6 ms, one can choose T3=2 ms and T2=1 ms.

After sending these two pulses, one again waits for period of time T3 (4-12). Then an internal variable VAR5 is initialised being given a certain value MAX (4-13). This internal variable will allow the width of the pulses which will subsequently be sent to the coil-moving mass unit to be defined.

Next, an internal variable PHASE is set at 1 (4-14). This internal variable will allow sub-programs to be selected.

Next, an internal variable CPT1 is set at 0 (4-15). This internal variable will play the role of a counter.

Next, an internal variable PUL is set at 0 (4-16.) This internal variable only passes to 1 when signal COMPT1 passes to 1, i.e. at the moment when induced voltage UIND across the terminals of coil L becomes positive (see FIG. 2 (2-4)).

Variable PUL is tested (4-17). As long as it is not equal to 1, the test is repeated. When it becomes equal to 1, i.e. in this case when UIND passes from a negative value to a positive value for the first time after the first oscillation period, sub-program BALANCE resets variable PUL at 0 (4-18), then returns to the main program (4-19).

It is clear now that the essential function of sub-program BALANCE is to cause the coil-moving mass unit to oscillate freely. By sending two oscillations at an interval of time substantially equal to half the nominal natural oscillation period of the coil-moving mass unit, a free oscillation of suitable amplitude is certain to be obtained.

After executing sub-program BALANCE, the main program again tests signal ALARM (3-5). If ALARM has passed to 0 again, i.e. if there is no need to activate the device according to the invention, the program sets signals DIAG1 (3-6) and DIAG2 (3-7) at 0, and sets signal SHORT (3-8) at 1. The oscillations of the coil-moving mass unit are thus damped.

If signal ALARM is kept at 1, i.e. if the activation procedure of the device according to the invention needs to be continued, the main program waits for the appearance of a signal TIC (3-6 and 3-7) originating from a time base. Typically, this time base is of the quartz type, and it can further be used to drive other functions related to those of the device according to the invention. For example, in the event that the device is intended to be fitted to a timepiece such as a watch, the time base will allow a time display to be driven using the usual frequency divider.

Figure 5:
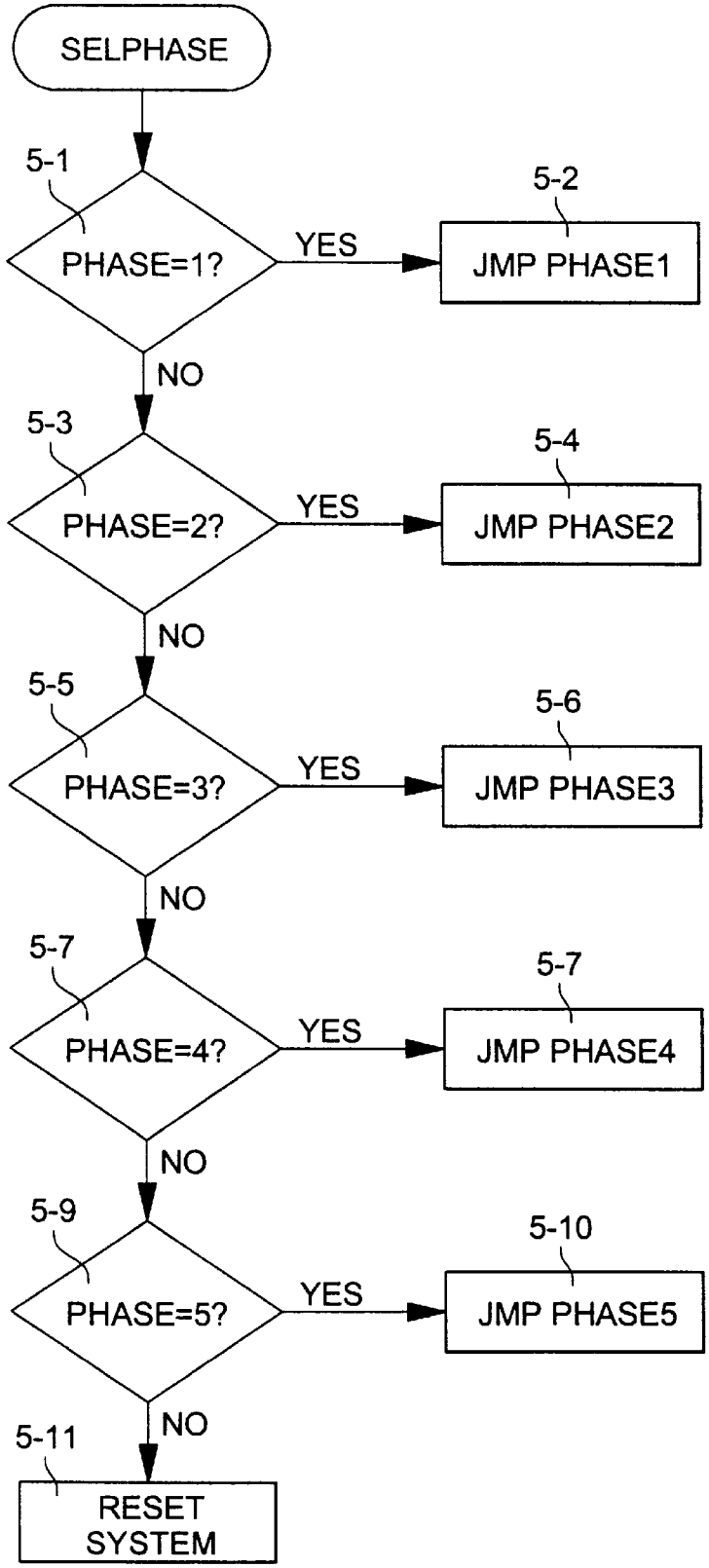
Figure 6:
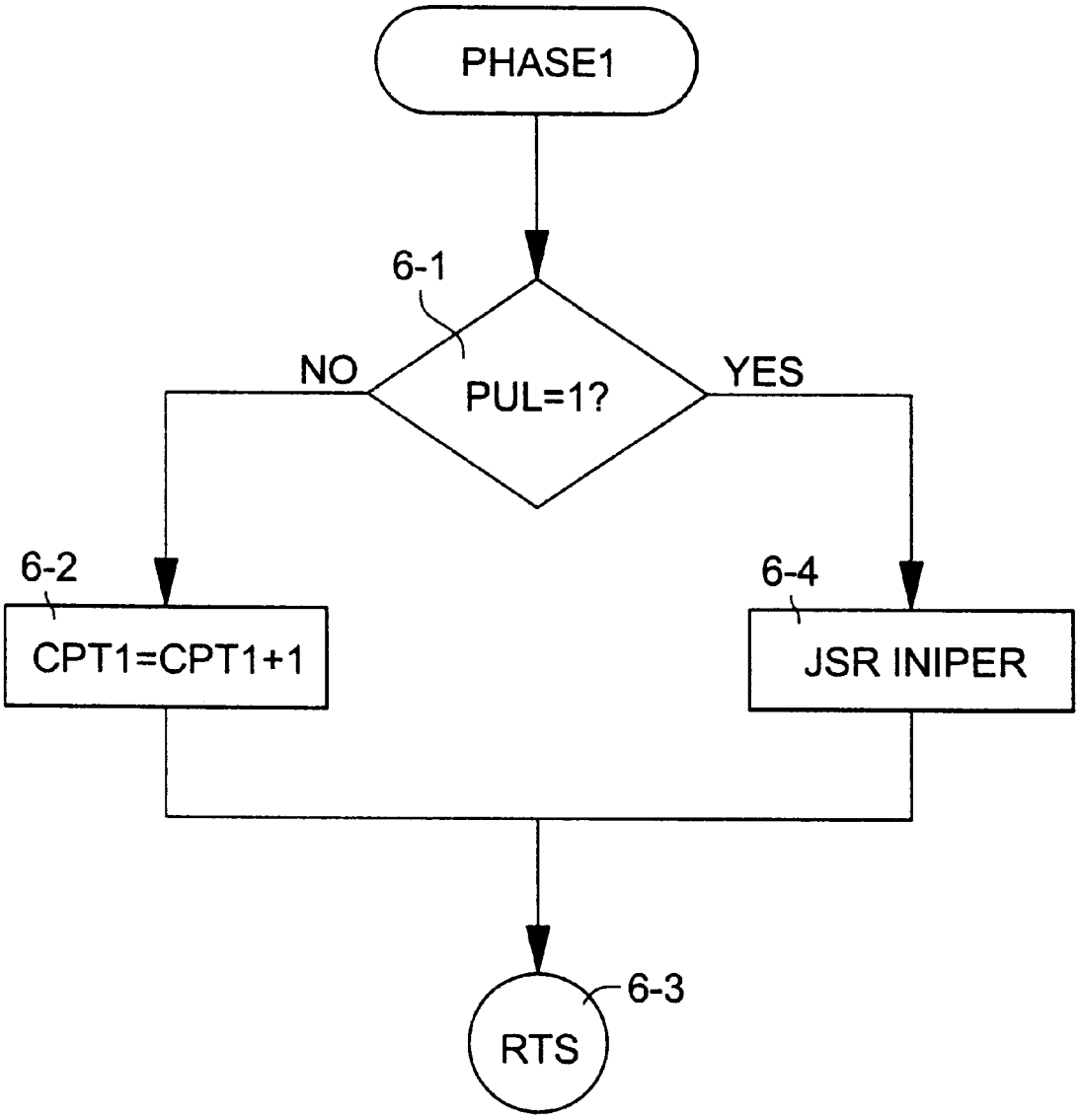

When signal TIC arrives, the main program executes sub-program SELPHASE (3-8) which concerns the phase selection. As can be seen in FIG. 5, this sub-program tests the internal variable PHASE:

- if PHASE has the value 1 (5-1), sub-program PHASE1 is executed (5-2);
- if PHASE has the value 2 (5-3), sub-program PHASE2 is executed (5-4);
- if PHASE has the value 3 (5-5), sub-program PHASE3 is executed (5-6);
- if PHASE has the value 4 (5-7), sub-program PHASE4 is executed (5-8);
- if PHASE has the value 5 (5-9), sub-program PHASE5 is executed (5-10);
- if PHASE is not equal to any value comprised between 1 and 5 (event of error), the main program is reinitialised (5-11).

During the first execution of sub-program SELPHASE, internal variable PHASE has the value 1: indeed, it has been set at this value by sub-program BALANCE (see above). In these conditions, sub-program SELPHASE begins by starting sub-program PHASE1 (see FIG. 6).

Sub-program PHASE1 begins by testing internal variable PUL (6-1). If PUL has the value 0, internal variable CPT1 is incremented by one unit (6-2), then one returns to the main program (6-3). If PUL has the value 1, sub-program INIPER is started (6-4).

Figure 7:
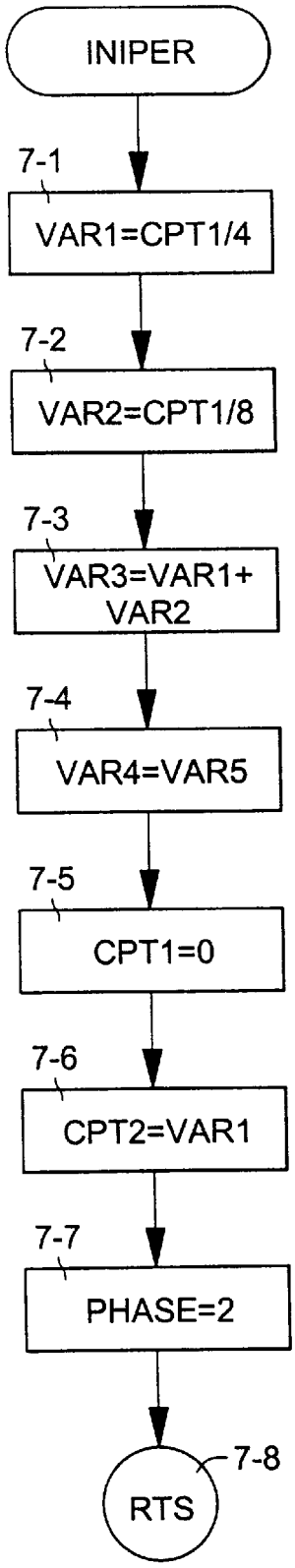

As can be seen in FIG. 7, sub-program INIPER, which concerns the initialisation of the period, allows a certain number of internal variables to be calculated and initialised. VAR1 (7-1) and VAR2 (7-2) are defined as having the respective values of a quarter and an eighth of the content of CPT1; VAR3 is equal to the sum of VAR1 and VAR2 (7-3); VAR4 is equal to VAR5 (7-4); CPT1 is set at 0 (7-5); CPT2 is equal to VAR1 (7-6); and PHASE is set at 2 (7-7). Next, sub-program INIPER returns to the main program (7-8).

As can be understood now (see FIG. 2 (2-5)), sub-program PHASE1 allows the duration separating two consecutive passages of variable PUL from 0 to 1 to be added up in variable CPT1, this duration being expressed in time base units. The period of the first free oscillation of the coil-moving mass unit is thus measured, i.e. its instantaneous natural oscillation period.

Sub-program INIPER, which is started once this instantaneous natural oscillation period has been calculated, allows the characteristics of the pulses which will subsequently be sent to the coil-moving mass unit to be defined so as to force it to oscillate. Thus, as will be seen, VAR1 will determine the phase of these pulses, VAR4 their width, and VAR2 and VAR3 will be used to start a safety procedure in the event of any brutal disturbance inflicted on the unit worn next to the body fitted with the device according to the invention.

At the end of the reiterated execution of sub-program PHASE1 then that of sub-program INIPER, variable PHASE has the value 2. Consequently, sub-program SELPHASE starts sub-program PHASE2.

Figure 8:
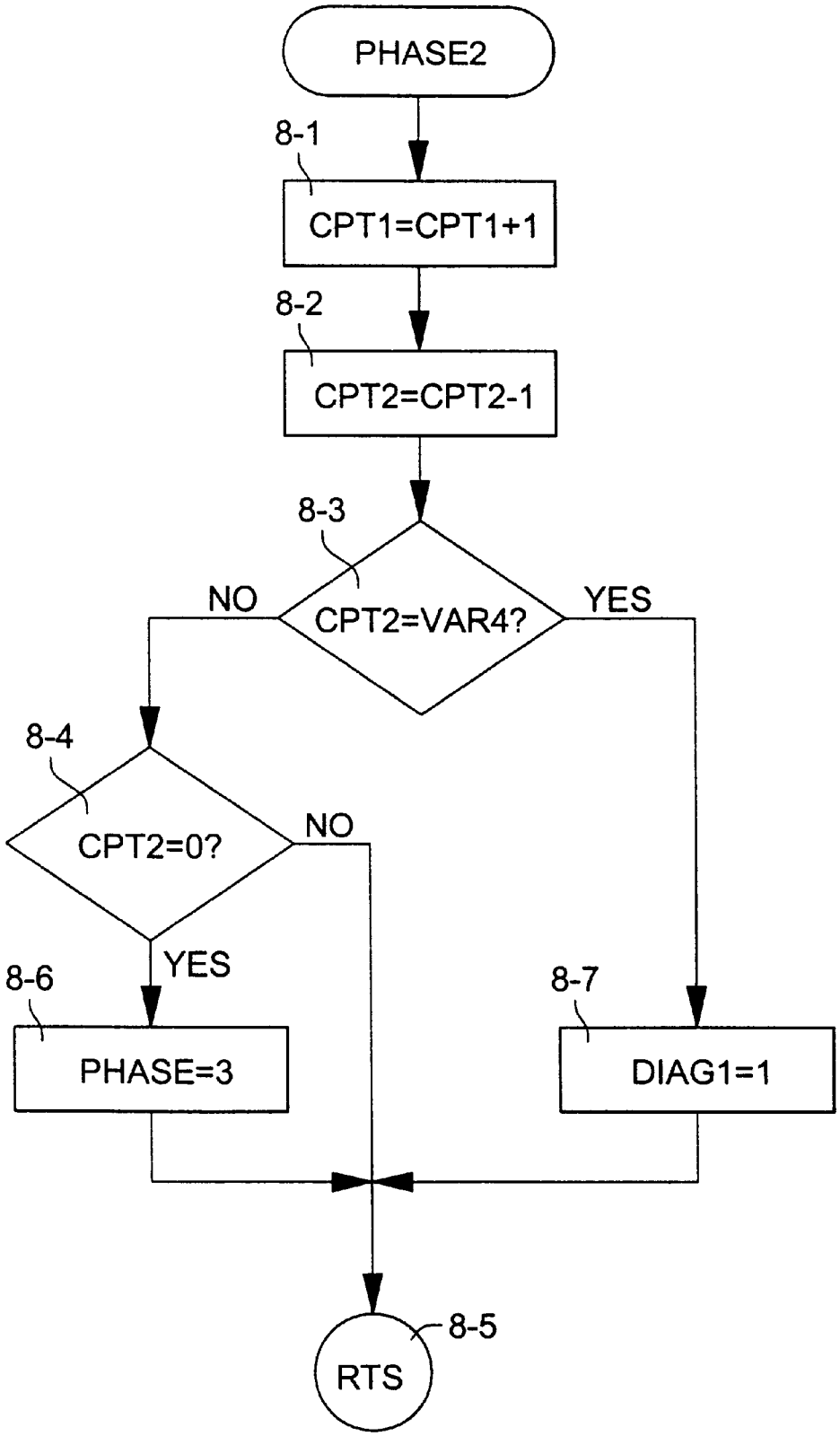

As can be seen in FIG. 8, sub-program PHASE2 begins by incrementing variable CPT1 by one unit (8-1), then by decrementing variable CPT2 by one unit (8-2). Then, variable CPT2 is tested (8-3). If it is different to variable VAR4, it is compared to 0 (8-4). If it is different to 0, one returns to the main program (8-5). If it is equal to 0, variable PHASE is set at 3 (8-6) prior to returning to the main program (8-5).

If variable CPT2 is equal to variable VAR4, signal DIAG1 is set at 1 (8-7) prior to returning to the main program (8-5).

As can now be understood (see FIG. 2 (2-6)), the duration of time taken by variable CPT2 to pass from value VAR1 to 0 is equal to a quarter of the duration of time which has elapsed during execution of sub-program PHASE1, i.e. to a quarter of the instantaneous natural oscillation period of the coil-moving mass unit.

A positive pulse is thus sent (2-7) to the unit at a moment (2-8) preceding by one time base unit the end (2-9) of the first quarter of its oscillation period.

After the reiterated execution of sub-program PHASE2, variable PHASE has the value 3. Consequently, sub-program SELPHASE starts sub-program PHASE3.

Figure 9:
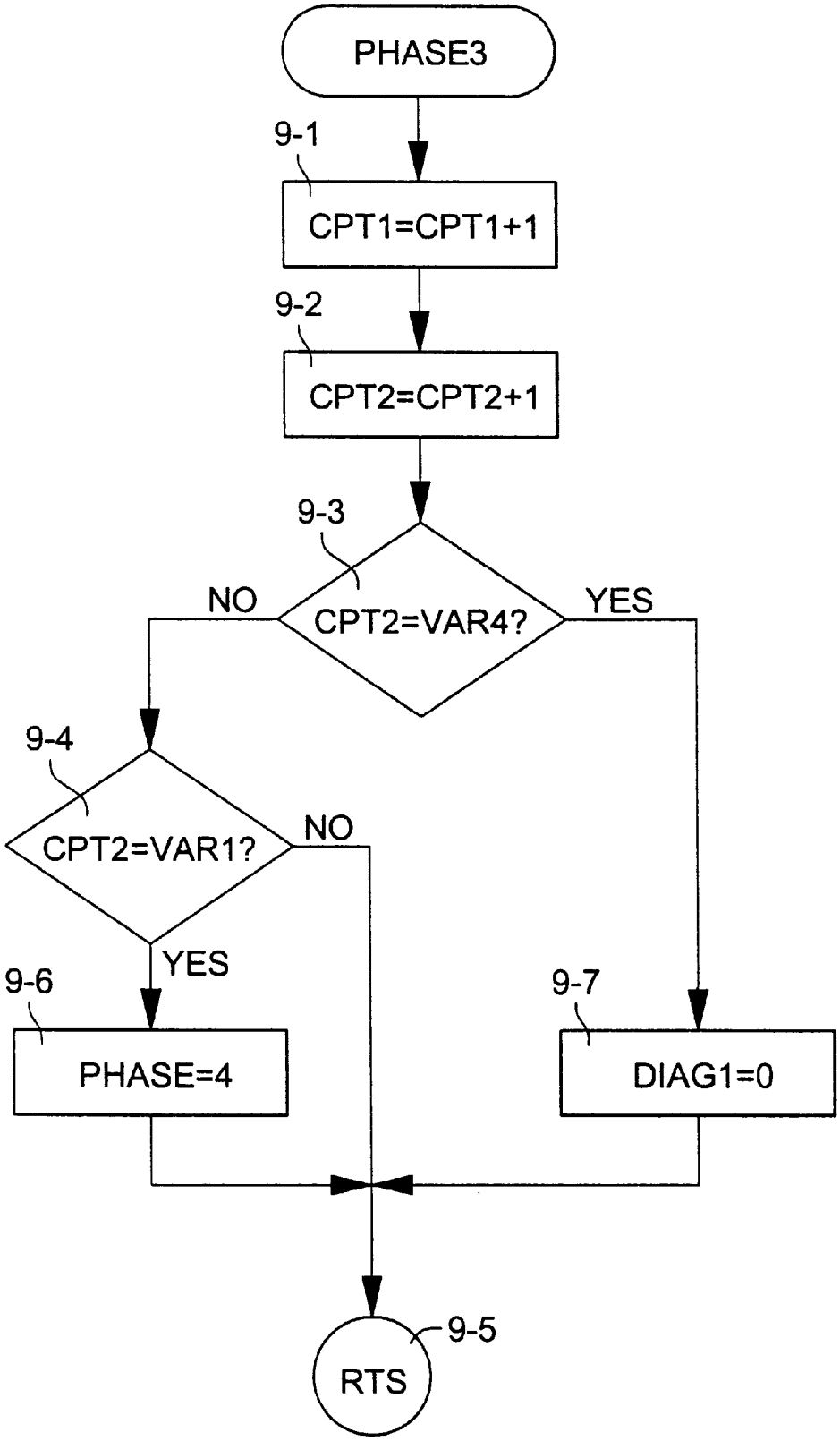

As can be seen in FIG. 9, sub-program PHASE3 begins by incrementing variable CPT1 by one unit (9-1), then by incrementing variable CPT2 by one unit (9-2). Next, variable CPT2 is tested (9-3). If it is different to variable VAR4, it is compared to variable VAR1 (9-4). If it is different to VAR1, one returns to the main program (9-5). If it is equal to VAR1, variable PHASE is set at 4 (9-6) prior to returning to the main program (9-5).

If variable CPT2 is equal to variable VAR4, signal DIAG1 is set at 0 (9-7) prior to returning to the main program (9-5).

As can now be understood (see FIG. 2 (2-10)), the duration of time taken by variable CPT2 to pass again from the value 0 to VAR1 is also equal to a quarter of one instantaneous natural oscillation period of the coil-moving mass unit.

The positive pulse (2-7) sent to this unit is thus interrupted during the preceding phase at a moment (2-11) succeeding by one time base unit the beginning (2-9) of the second quarter of the oscillation period.

One has thus succeeded in sending a positive pulse (2-7) to the coil-moving mass unit in phase with respect to its amplitude peak (2-12).

It can be seen here that the value of VAR1 determines moments 2-8 and 2-11 when variable CPT2 is equal to variable VAR4, and thereby temporal position 2-7 with respect to the oscillation of the coil-moving mass unit.

After the reiterated execution of sub-program PHASE3, variable PHASE has the value 4. Consequently, sub-program SELPHASE starts sub-program PHASE4.

Figure 10:
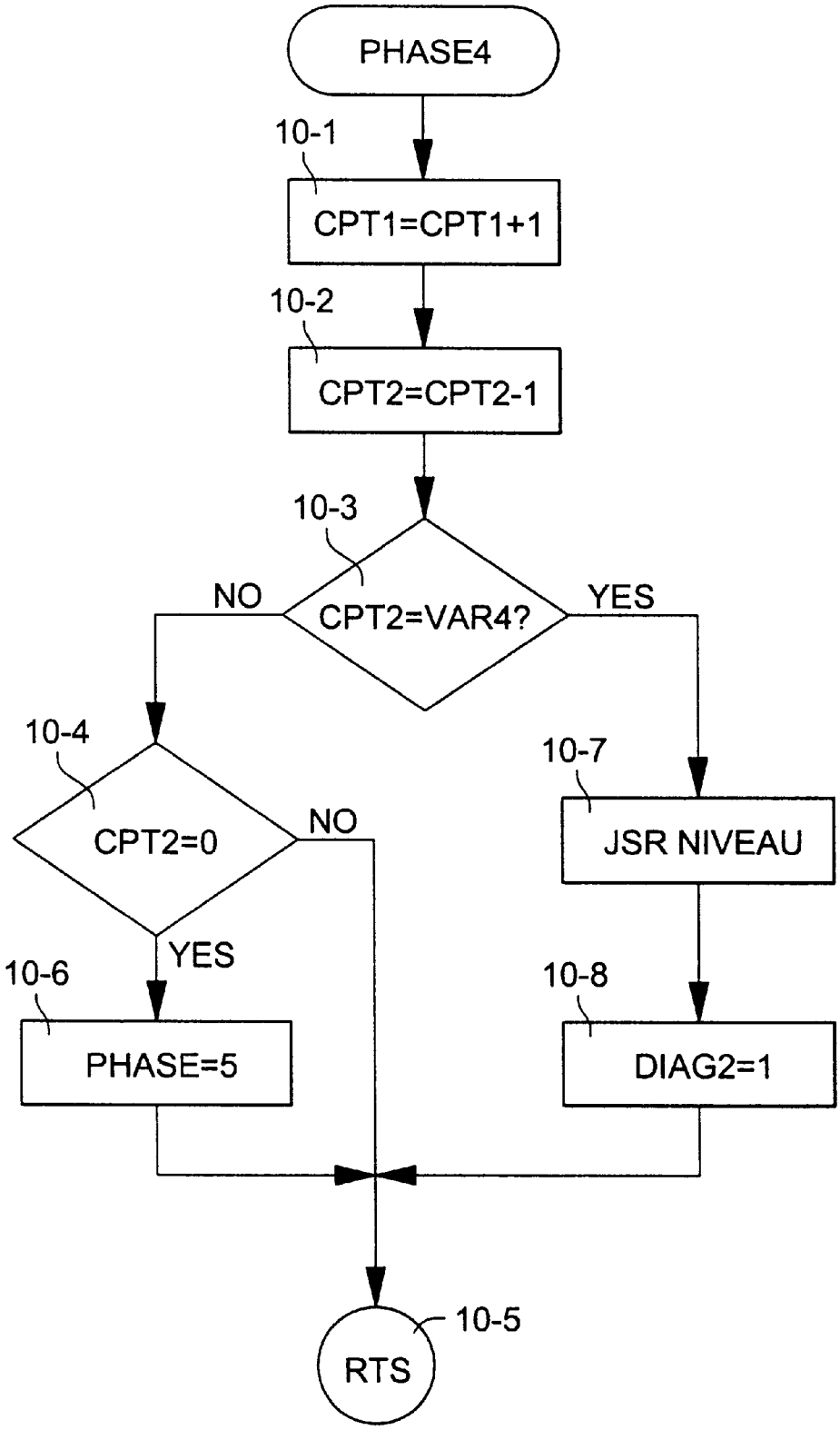

As can be seen in FIG. 10, sub-program PHASE4 begins by incrementing variable CPT1 by one unit (10-1), then by decrementing variable CPT2 by one unit (10-2). Next, variable CPT2 is tested (10-3). If it is different to variable VAR4, it is compared to 0 (10-4). If it is different to 0, one returns to the main program (10-5). If it is equal to 0, variable PHASE is set at 5 (10-6) prior to returning to the main program (10-5).

If variable CPT2 is equal to variable VAR4, a sub-program LEVEL is executed (10-7) prior to setting signal DIAG2 at 1 (10-8) then returning to the main program (10-5).

FIG. 11 shows a first variant of sub-program LEVEL. One begins by testing signal COMP2 (11-1). If this signal does not have the value 1, i.e. if induced voltage UIND across the terminals of coil L is less than reference value REFA, internal variable VAR5 is set at value MAX (11-2), then one returns to sub-program PHASE4 (11-4). If this signal has the value 1, i.e. if UIND is greater than REFA, variable VAR5 is set at the value MIN (11-39), then one returns to sub-program PHASE4 (11-4).

FIG. 12 shows a second variant of sub-program LEVEL. It begins by testing signal COMP2 (12-1). If this signal does not have the value 1, variable VAR5 is compared to value MAX (12-2). If VAR5 is not equal to MAX, it is incremented by one unit (12-3), then one returns to sub-program PHASE4 (12-4). If VAR5 is equal to MAX, one returns directly to sub-program PHASE4 (12-4).

If COMP2 has the value 1, variable VAR5 is compared to value MIN (12-5). If VAR5 is not equal to MIN, it is decremented by one unit (12-6), then one returns to sub-program PHASE4 (12-4). If VAR5 is equal to MIN, one returns directly to sub-program PHASE4 (12-4).

As will easily have been understood in light of the description of sub-program PHASE2, sub-program PHASE4 allows a negative pulse (2-15) to be sent at a moment (2-14) preceding by one time base unit the end (2-15) of the third quarter of the oscillation period of the coil-moving mass unit.

The role of sub-program LEVEL is to regulate the oscillation amplitude of the unit.

With reference to the flow chart of sub-program INIPER (FIG. 7), it can be seen (7-4) that VAR5 is in fact the value attributed to VAR4 during initialisation of the variables which takes place at the beginning of each new oscillation period of the coil-moving mass unit.

It is clear from the foregoing that the value of VAR4 determines the beginning and end moments of the pulses sent to the unit, and thus their duration. With reference to FIG. 2 (see 2-8 and 2-11), it will be understood that this duration increases when VAR4 increases, and conversely.

The amplitude of the oscillations of the coil-moving mass unit depends directly upon the duration of the pulses which are sent thereto: the greater said duration, the greater the amplitude, and conversely.

Thus, it appears that, by playing with the value of variable VAR5, the two variants of sub-program LEVEL allow the amplitude of the oscillations of the coil-moving mass unit to be regulated. This regulation can be effected either in a binary manner, with a high level MAX and a low level MIN (variant of FIG. 11), or in a gradual manner, with intermediate values comprised between these two levels (variant of FIG. 12).

At the end of the reiterated execution of sub-program PHASE4 then that of sub-program LEVEL, variable PHASE has the value 5. Consequently, sub-program SELPHASE starts sub-program PHASE5.

As can be seen in FIG. 13, sub-program PHASE5 begins by incrementing variable CPT1 by one unit (13-1), then by incrementing variable CPT2 by one unit (13-2). Next, variable CPT2 is tested (13-3). If it is different to variable VAR4, it is compared to variable VAR2 (13-4). If it is greater than VAR2, it is compared to VAR3 (13-5). If it is different to VAR3, variable PUL is tested (13-6). If PUL does not have the value 1, one returns to the main program (13-7). If PUL has the value 1, sub-program INIPER is executed (13-8) prior to returning to the main program (13-7).

If variable CPT2 is equal to variable VAR3, the main program is reinitialised (13-9).

If variable CPT2 is lower than variable VAR2, variable PUL is set at 0 (13-10), then one returns to the main program (13-9).

If variable CPT2 is equal to variable VAR4, signal DIAG2 is set at 0 (13-11), then one returns to the main program (13-7).

As will easily have been understood in light of the description of sub-program PHASE3, sub-program PHASE5 allows the negative pulse (2-13) sent to the coil-moving mass unit to be interrupted during the preceding phase at a moment (2-16) succeeding by one time base unit the beginning (2-15) of the fourth quarter of the oscillation period.

One has thus managed to send a negative pulse (2-13) to the coil-moving mass unit in phase with respect to its amplitude dip (2-17), i.e. at the maximum negative of the induced voltage UIND. Of course, the maximum induced voltage corresponds to the maximum speed of the coil-moving mass unit.

Moreover, the two variables VAR2 and VAR3 define first (2-18) and second (2-19) moments symmetrically framing the moment (2-20) when variable CPT2 reaches value VAR1, i.e. theoretically, the moment when the fourth quarter of forced oscillation period of the coil-moving mass unit ends and when PUL returns to 1.

If this unit is greatly disturbed in its oscillation, for example by an external jolt, the moment when PUL returns to 1 is liable to be significantly offset with respect to its theoretical position. The purpose of the successive tests of sub-program PHASE5 is to situate the moment when PUL returns to 1 with respect to moments 2-18 and 2-19.

If this moment is prior to moment 2-18 or subsequent to moment 2-19, i.e. if variable CPT2 reaches VAR3 before PUL returns to 1 (test 13-5), this means that the coil-moving mass unit has suffered a disturbance liable to modify significantly its instantaneous natural oscillation frequency: a new measurement must therefore be taken by restarting the entire program (13-9).

If this moment is comprised between moments 2-18 and 2-19 (test 13-6), sub-program INIPER is executed, and calculates as indicated hereinabove the parameters of the following period, in particular from the duration added up in variable CPT1.

In this case, sub-program PHASE2 again follows sub-program PHASE5, and the cycle is repeated in a similar manner, adapting its parameters from period to period to the oscillation frequency of the coil-moving mass unit, and to the amplitude of said oscillation.

It is now clear that adjustment of the pulses sent to the coil-moving mass unit is obtained as a result of three different procedures.

The first procedure, which occurs at the beginning of the activation of the device according to the invention or during a brutal disturbance, allows the frequency and the temporal position of the pulses to be adapted as a function of the characteristics of the free oscillation of the coil-moving mass unit.

The second procedure, which occurs during the forced oscillation of the unit, allows the frequency and phase of the pulses to be corrected at the beginning of each new period.

The third procedure, which also occurs during the forced oscillation of the coil-moving mass unit allows its oscillation amplitude to be adjusted.

These three adjustment procedures could be implemented independently of each other. This having been said, they appear perfectly complementary with respect to the object of the invention, which is to make a device with optimum energy efficiency.

The device according to the invention is stopped as soon as signal ALARM passes to 0 in the main program. Signals DIAG1 and DIAG2 are then set at 0 and signal SHORT is set at 1, thus rapidly damping the oscillation of the coil-moving mass unit. The main program then rotates in a waiting loop while waiting for signal ALARM to pass to 1 again.

Of course, the invention is not limited to the embodiment described and shown which has only been given by way of example. Thus, for example, only one or more than two pulses could be sent per period to the coil-moving mass unit.

What is claimed is:

1. A non acoustic alarm device, intended to be fitted to a portable device worn next to the body for use in a timepiece or a portable telephone, the non acoustic alarm device including:

a case;

a moving mass within the case intended to transmit vibrations thereto;

a coil electromagnetically coupled to said moving mass to cause said moving mass to oscillate, wherein said coil and said moving mass form a coil-moving mass unit; and an excitation circuit of said coil, wherein said non acoustic alarm device further includes means for measuring the instantaneous oscillation frequency of the coil-moving mass unit during the period of oscillation in progress, as well as means for generating, during the next period of oscillation, a series of excitation pulses for said coil, said series of excitation pulses having characteristics that are a function of the measurement of said instantaneous oscillation frequency, said moving mass oscillating freely between two successive excitation pulses so as to allow a measurement of said instantaneous oscillating frequency of the coil-moving mass unit.

2. The device according to claim 1, wherein said excitation pulses are generated at instants substantially corresponding to the maxima of the voltage induced across the terminals of said coil by the movement of the moving mass.

3. The device according to claim 1, including means for sending at least one pulse to the coil prior to the forced oscillation of the coil-moving mass unit or following a brutal disturbance suffered by said unit worn next to the body, in order to measure the instantaneous natural oscillation frequency of said unit.

4. The device according to claim 3, including means for sending to the coil, prior to the forced oscillation of the coil-moving mass unit or following a brutal disturbance suffered by said unit worn next to the body, two pulses of opposite signs at an interval of time substantially equal to half the nominal natural oscillation period of the coil-moving mass unit.

5. The device according to claim 1, including a time base, means for testing the sign of the induced voltage across the terminals of the coil and a first counter activated at each signal from the time base, this counter adding up the duration separating at least two consecutive sign changes of said induced voltage, thus allowing the instantaneous oscillation frequency of the coil-moving mass unit to be measured.

6. The device according to claim 5, including a second counter activated at each signal from the time base and parameterized as a function of the measurement of the instantaneous frequency of the preceding oscillation of the coil-moving mass unit, and including means allowing to release a series of excitation pulses for the coil of the same frequency as said instantaneous frequency as a function of the value of said second counter.

7. The device according to claim 6, wherein:

the second counter is fixed, at each beginning of oscillation of the coil-moving mass unit, as being equal to a first variable having the value of a quarter of the value reached by the first counter at the end of the preceding oscillation, said second counter passes from said first variable to 0 then from 0 to said first variable twice in succession, each passage lasting a quarter of the period of said preceding oscillation;

a first pulse of a first given polarity is sent to the coil between first and second moments when said second counter is equal to a second variable less than said first variable; and a second pulse of a second opposite polarity is sent to said coil between third and fourth moments when said second counter is equal to said second variable, so as to cause said first and second pulses to coincide substantially to the two maximums of voltage induced by the movement of said coil-moving mass unit.

8. The device according to claim 7, including means for adjusting the value of the second variable, wherein the means for adjusting the value of the second variable also adjusts the duration separating the first moment from the second moment, and the duration separating the third moment from the fourth moment, wherein the adjustment in the duration separating the first moment from the second moment, and the third moment from the fourth moment, is a function of the amplitude of the preceding oscillation of the coil-moving mass unit in order to adjust the amplitude of the oscillation in progress.

9. The device according to claim 6, including means for reinitializing the coil excitation procedure in the event of a jolt inflicted on the coil-moving mass unit.

10. The device according to claim 9, characterized in that it includes means for comparing the moment when the induced voltage effectively changes sign at the end of a period with respect to fifth and sixth moments framing the theoretical moment when this passage would have occurred in the absence of any disturbance.

11. The device according to claim 1, wherein the coil is controlled by a duly programmed unit such as a microprocessor.

* * * * *